United States Patent [19]

James et al.

[11] Patent Number: 4,772,025

[45] Date of Patent: Sep. 20, 1988

[54] LOTTERY TICKET REVIEWING DEVICE

[76] Inventors: Jimmie J. James, 5581 Paradise Dr., Corte Madera, Calif. 94925; Susanna Melnilcoff, 366 Glaciar Ct., San Rafael, Calif. 94902

[21] Appl. No.: 98,809

[22] Filed: Sep. 21, 1987

[51] Int. Cl.[4] ..... A63F 3/06

[52] U.S. Cl. ..... 273/148 R; 434/354

[58] Field of Search ..... 273/148 R; 434/354

[56] References Cited

U.S. PATENT DOCUMENTS 4,600,198 7/1986 Fox ..... 273/148 R

FOREIGN PATENT DOCUMENTS 727872 2/1966 Canada ..... 434/354

*Primary Examiner*—Anton O. Oechsle

*Attorney, Agent, or Firm*—Thomas M. Freiburger

[57] ABSTRACT

A device in the configuration and appearance of a slot machine enables a lottery player to compare the combination of numbers he has selected and entered in the lottery with the winning series of numbers from a lottery drawing. A window in the front of the fanciful slot machine device displays numbers on dial wheels which are set by the user in accordance with the winning numbers drawn in the lottery. Below the winning lottery number window is a window or series of windows disposed in a horizontal line, for displaying the user's selected combination of numbers from a lottery ticket fed through an infeed slot and into position by means of an advancing wheel or knob manually rotated by the user. All number combinations selected by the user can be compared directly with the winning numbers by advancing the ticket, number series by number series, to make comparisons sequentially to the winning number combination.

7 Claims, 1 Drawing Sheet

LOTTERY TICKET REVIEWING DEVICE

BACKGROUND OF THE INVENTION

The invention relates to equipment for assisting a lottery player in playing a lottery game.

Many states have lotteries wherein those playing the lottery game select arbitrarily a series of numbers, which if successfully selected, will match a series of numbers drawn in the lottery game. The lottery player is issued a ticket or receipt at the time of his number selection and payment, on which the selected numbers are printed. Often a player will make a number of entries of number selections, such as four or five at the same time, and the four or five number combinations will be printed on the same customer ticket in a series of horizontal rows, one above the other.

A number of state lotteries have a similar format for the random number lottery game. In many lotteries, six numbers are randomly selected, and on the customer's ticket, each of the customer's entered series of numbers are printed on the ticket in a particular order, such as low-to-high order.

When the lottery drawing occurs for the lottery game entered by the customer, the winning numbers are published in a similar order to that used on the customer ticket receipts, e.g. low-to-high. The customer then compares each of his entries of series of selected numbers with the published winning series of numbers, to determine if the customer has picked the winning combination.

It is an object of the present invention to assist the lottery customer in the comparison of each of his entered series of numbers with the winning combination, so that the customer can quickly and easily make a number of comparisons, including whether he has correctly picked six out of six numbers, five out of six numbers, four out of six numbers, etc.

SUMMARY OF THE INVENTION

The present invention accomplishes these objectives with a lottery number comparison device in the fanciful shape and appearance of a miniature slot machine.

The slot machine-appearing device has no slot machine function, and does not receive a coin, but preferably has the configuration and markings of a slot machine and a dummy slot machine handle on one side. A series of number wheels, manually manipulatable from the back of the device's housing, each bear all numbers available for selection in the lottery game. When winning lottery numbers are published or announced, the user/lottery customer can rotate the number wheels or dials to show the series of winning numbers through a window at the front of the housing. The user then inserts his printed lottery ticket in the front of the housing through a ticket receiving slot, and each series of numbers constituting an entry can be viewed in succession through a window or windows adjacent to the winning number window. The numbers are advanced to the viewing windows by manual rotation of a knob or feed wheel on the side of the housing, and this advancing wheel can be configurationally integrated with the dummy slot machine handle.

The user advances his lottery ticket through the device to the point that the first lottery entry constituting a series of, for example, six numbers in a horizontal array are exposed through the windows. Each number is directly below and juxtaposed with one of the numbers of the winning lottery number series, each series of numbers being arranged in a prescribed order, e.g. low-to-high. This gives the user an instant comparison of his series of numbers with the winning series of numbers, and he can immediately identify whether one, two, three, four, five or six of the numbers match with the winning numbers.

Once the comparison is made with one lottery entry, the user advances his ticket to the position where the next entry constituting the next series of horizontally arrayed numbers are aligned in the windows and juxtaposed with the winning series of numbers. The comparison is made, and this process is repeated for all entries printed on the customer's ticket.

In a preferred embodiment, the ticket insert slot is near the bottom of the fanciful slot machine housing, with the housing being only slightly wider than the width of a lottery ticket. The ticket number viewing window(s) is above the insert slot, and the ticket is advanced by means of a soft, high-friction roller attached to the manual advancing wheel on the side of the housing. As the ticket advances, its leading end is fed out an exit slot in the back of the housing. The manually manipulatable number wheels or dials preferably comprise number wheels lying generally in parallel vertical planes and rotatable on a common horizontal axis, with edges of the wheels extending through the back side of the housing for rotation by the user.

Also in a preferred embodiment, there may be included a bonus wheel at the top of the housing, also visible through a viewing window. This number wheel may be in a generally vertical plane perpendicular to those of the series of parallel winning wheels, and on an axis which is generally horizontal and oriented front-to-back in the housing. The exposed portion of the number wheel for manipulation by the user may be at the top of the housing, but surrounded by housing structure simulating a coin slot at the top of the device.

The device of the invention makes lottery number comparisons simple and efficient, while also having a novelty slot machine appearance in keeping with the gaming nature of the lottery, making winning ticket determination more enjoyable and fun for the lottery player. Other objects, advantages and features of the invention will be apparent from the following description of a preferred embodiment, considered along with the accompanying drawings.

DESCRIPTION OF THE DRAWINGS

FIGS. 1 and 2 show a customer's lottery ticket extending into the device, having been fed through a ticket infeed slot at the front and exposing numbers through a window at the front of the device.

DESCRIPTION OF PREFERRED EMBODIMENT

Figure 1:
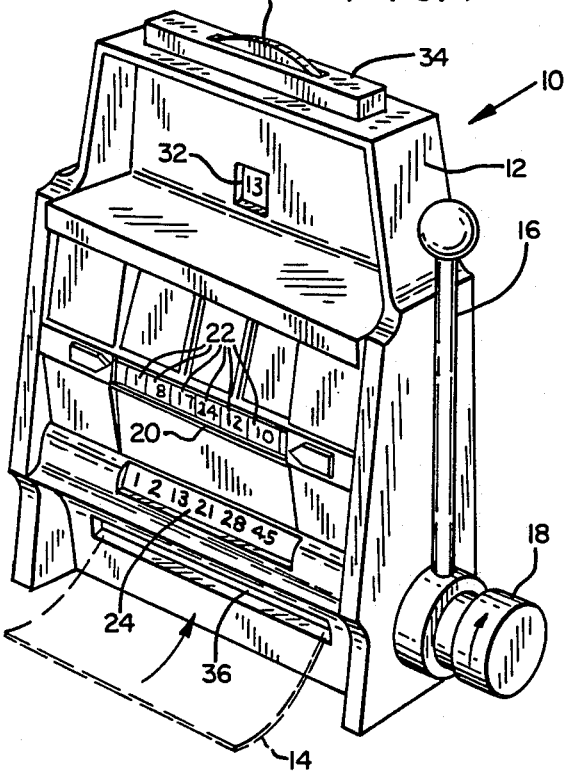
FIG. 1 is a frontal perspective view showing a lottery ticket comparison device in the fanciful shape of a small slot machine, in accordance with the principles of the invention.
Figure 2:
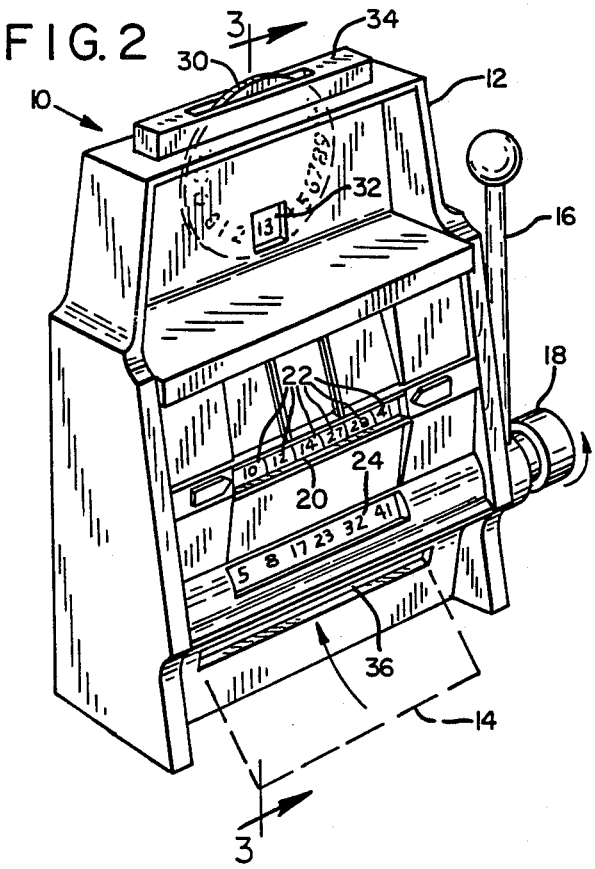
FIG. 2 is another frontal perspective view of the device, from the opposite side.

In the drawings, FIG. 1 shows a lottery ticket comparison device 10, in the fanciful configuration and appearance of a small slot machine. The device 10 has a housing 12 which is slightly wider than the width of a lottery ticket 14 which it receives, as shown in FIG. 2.

The lottery ticket comparison device 10 includes a slot machine type arm 16 connected to the housing, which may be used to advance the lottery ticket 14 through the device, but which preferably is a dummy arm. The dummy arm is fixed on the side of the housing 12 to add to the slot machine appearance, with the ticket advancing instead accomplished by a manual advancing wheel or knob 18 located at the apparent pivot point of the slot machine lever arm 16.

Figure 4:
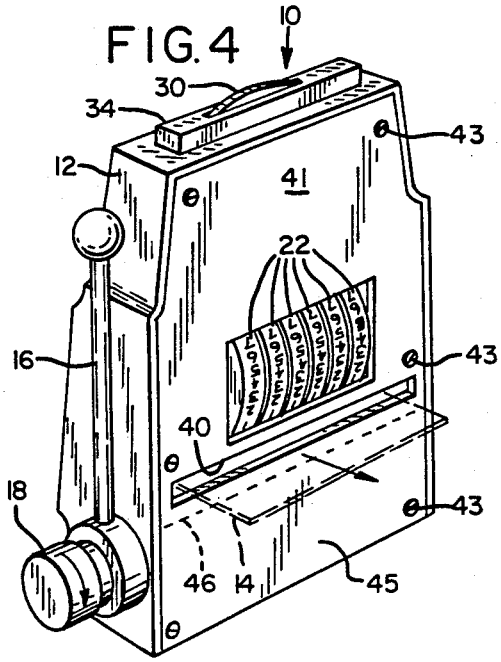
FIG. 4 is a rear perspective elevation view of the device of the invention, showing the manually settable number wheels, the ticket exiting the slot, and other features.

Also included on the device's housing 12 is a window 20 or series of windows through which are visible small portions of a series of number wheels or dials 22. Each wheel or dial exposes a number through the window 20, as individually selected and manually input by the user by manipulation at the back of the device. FIG. 4 shows the number wheels 22 (which may be six, if the lottery game for which the device is used involves the selection of six numbers), exposed and partially extending out the rear of the housing for manipulation by the user. Ordinarily a larger number of numbers will be present on each wheel than what is indicated in the drawings. Fewer are shown for simplicity.

The housing 12 also has an additional window 24 or series of windows 24 positioned below or otherwise in adjacent juxtaposed relation to each of the numbers displayed on the series of number wheels 22. Through the window 24, as shown in the drawings, are displayed the series of numbers selected by the lottery player/user in entering the lottery game. The customer-selected numbers are lined up with and are directly comparable against the numbers on the set wheels 22, which are set by the customer in accordance with the published winning series of numbers from the lottery drawing in question.

As further explained below, the customer-selected lottery entry numbers are advanced into registry with the window 24 when the number comparison is to be made. Many lottery customers will make a number of entries at one time, for example four or five or six entries, and these are normally printed as a series of horizontal entries progressing down the length of the receipt/lottery ticket 14. Thus, the ticket 14 might bear a matrix-appearing set of numbers printed fairly closely together, with horizontal rows of numbers, the number of numbers in each row corresponding to the number of numbers to be drawn in the lottery game. The number of rows corresponds to the number of entries made by the customer on this ticket or receipt 14. Without the comparison device of the invention, it can be difficult to make the needed comparison from such a density of numbers.

An optional feature which may be included on the lottery ticket comparison device 14 is a bonus number wheel 30. This may be rotatably mounted at the top of the housing 12 as shown, for setting of a number by the customer, visible through a bonus number display window 32. The number set here corresponds to a bonus number selected and published for the particular lottery game. In some lotteries such a bonus number, if it corresponds to one of the customer's entered numbers, can lead to a prize.

As illustrated in the drawings, the top portion of the bonus number wheel 30 (for manipulation by the user) may be surrounded by a housing portion 34 appearing as a coin slot, so that the top of the number wheel 30 may appear as a coin in the coin slot.

Figure 3:
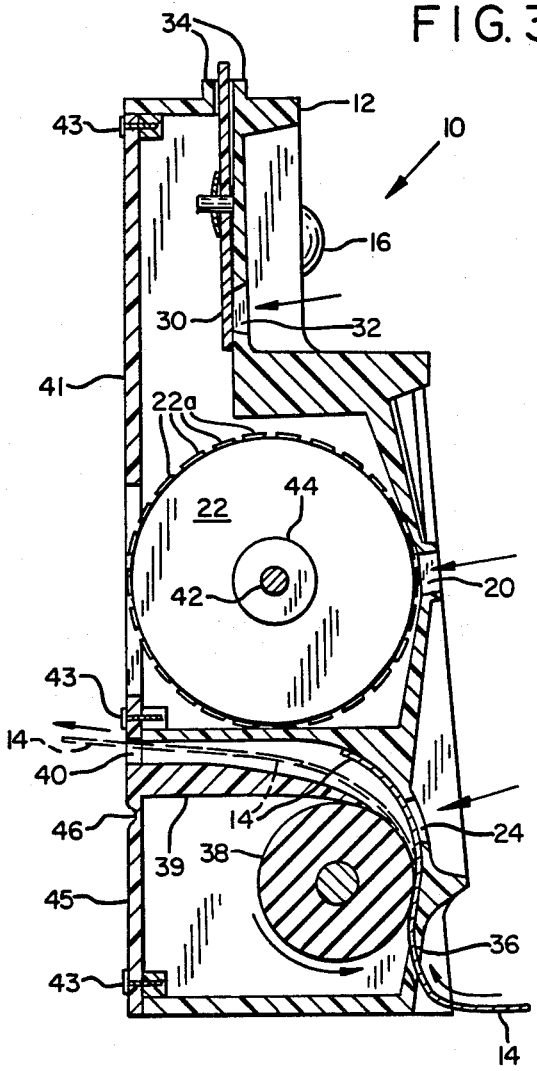
FIG. 3 is a side elevation view in section, showing the lottery ticket as it is advanced through the device by a roller and showing the ticket positioned behind the ticket viewing window and extending out an exit slot at the back of the device, and also showing one of a plurality of manually settable number wheels for showing winning lottery numbers at the front of the device.

The sectional view of FIG. 3 shows the customer's lottery ticket or receipt 14 being advanced through the device. The ticket is inserted into the device through an infeed slot 36 at the front of the housing 12, preferably near the bottom of the housing as shown, and is then advanced into and through the device using the ticket advancing wheel or knob 18 at the side of the housing. This is accomplished by a feed roller 38, preferably in direct drive relation with the manual advancing knob 18. The roller 38 may comprise, for example, a high-friction cylindrical foam roller, so that the ticket can be advanced through the device (with little resistance encountered inside the device) without the need for a complementary pinch roller coacting with the roller 38.

A guide plate 39 preferably extends from a back panel 41 of the housing to a position close to the roller 38, to assure the proper path of travel for the lottery ticket 14, even if it has a tendency to curl.

As FIG. 3 shows, the lottery ticket 14 is advanced and guided through the housing such that it passes directly adjacent to the window 24 for displaying the customer-selected lottery entry numbers.

A first series or entry of customer-selected numbers is displayed through the window 24 and directly compared with the published winning series of numbers exposed on the number wheels 22 directly above (or otherwise adjacent to) the customer's entered numbers. It can quickly and easily be determined by the user whether one, two, three or more of his selected numbers correspond to the published winning numbers. The ticket advancing knob 18 is then be rotated to expose the next series or entry of numbers on the customer's ticket through the display windows 24, so that the comparison can be made again.

This comparison is made for each of the customer's series of entered numbers, and as the ticket 14 is advanced, its leading end is fed out an exit slot 40 at the back side of housing 12, as shown. When the comparisons have been completed, the remainder of the ticket 14 may be fed out the exit slot 40 using the ticket advancing knob 18, or the lottery ticket 14 may simply be pulled out the exit slot.

In case of trouble in feeding the ticket through the device, the back panel 41 of the housing can be removed via retaining screws 43. If the ticket feeds below the guide plate 39, only the bottom retaining screws 43 need be removed, and a lower portion 45 of the back panel can then be pivoted up via a plastic hinge 46 as indicated in FIGS. 3 and 4.

As the drawings illustrate, the settable winning number wheels 22 have number indicia on their outer peripheral edges 22*a*, with these numbers corresponding to the range of numbers selectable for lottery entries. The number wheels 22 may be mounted on a common shaft 42 extending through the width of the housing 12, with the wheels 22 having some frictional element at their connection to the shaft 42. This may comprise rubbery sleeves 44 between adjacent number wheels, slightly compressed axially upon assembly and nonrotatable on the shaft 42, providing a desired degree of friction to hold each of the number wheels in position once set.

It should be understood that although the device of the invention is shown in a preferred, very simple embodiment, additional features may be incorporated. For example, as mentioned above, the "slot machine" arm 16 may be pivotally mounted on the housing and either geared to or directly driving the frictional lottery ticket advancing roller 38, so that the customer/user actually pulls this handle until the lottery ticket is correctly positioned for viewing of the customer-selected entry numbers through the window 24. For this purpose, the handle or arm 16 would be capable of driving the roller 38 in the forward direction only, such as with a ratchet arrangement.

The above described preferred embodiments illustrate the principles of the invention, but are not intended to be limiting of its scope. Various other embodiments and changes to these preferred embodiments will be apparent to those skilled in the art and may be made without departing from the scope of the following claims.

I claim:

1. A device for comparing lottery tickets to winning lottery numbers, in a lottery game wherein a series of numbers are selected by customers, which if successfully selected will match a series of winning numbers drawn in the lottery, comprising:

a housing generally in the configuration of and having the appearance of a slot machine, but smaller in size, a series of manually settable number dials or wheels rotatably mounted in the housing, each number dial having all possible numbers which can potentially be selected in the lottery for each number position, the number of number dials being at least equal to the number of numbers to be selected in the lottery drawing for which the device is used, so that the user/lottery customer can set the number dials to match the winning numbers selected in a lottery drawing, with the series of winning numbers appearing in a horizontal series through an opening in the front of the device, a lottery ticket infeed slot in the front of the housing, rotatable ticket feed means in the housing and adjacent to the infeed slot, with a manually rotatable knob outside the housing, for advancing a lottery ticket into and through the housing when the lottery ticket is placed in the infeed slot and the knob is manually rotated, ticket viewing window means in the front of the housing, in a generally linear horizontal arrangement and positioned so that numbers on a lottery ticket are viewable through the window means, with a ticket number directly adjacent to and aligned vertically with each of the manually dialed lottery winning numbers visible at the front of the device, and an outfeed slot in the device, through which the lottery ticket exits the device, whereby the user can first determine the published winning numbers in a lottery and set the plurality of number dials accordingly to expose the series of winning lottery numbers on the dials at the front of the machine, arranged in a horizontal line in a prescribed sequence as published, then feed into the device a lottery ticket having customer-selected series of numbers, rotate the knob to advance the lottery ticket into the device to a point where the first row of numbers on the ticket is directly behind the window means and thus adjacent to the manually input numbers on the number dials, number by number, and make a comparison of the numbers; and if multiple series of customer-selected lottery numbers are on the lottery ticket, the user can review each series of numbers sequentially, comparing them with the adjacent series of winning numbers and advancing the lottery ticket forward through the device to position the next series of numbers on the ticket behind the viewing windows, make another comparison, and so on.

2. The device of claim 1, wherein the lottery ticket viewing window means is below the exposed numbers of the manual dials, as the front of the device is viewed.

3. The device of claim 1, further including a bonus number dial at the top of the housing, for setting a bonus number selected in the lottery and positioning it to be viewed through a bonus number window in front of the housing.

4. The device of claim 3, wherein the bonus number dial has adjacent to it a housing portion giving the appearance of a coin slot at the top of the housing.

5. The device of claim 1, wherein the housing has attached to one side a non-functional slot machine lever, adding to the appearance of a slot machine.

6. The device of claim 1, wherein the ticket outfeed slot is at the rear of the housing.

7. The device of claim 1, wherein the rotatable ticket feed means comprises a single soft, high-friction roller for engaging a surface of the lottery ticket.

* * * * *